United States Patent [19]

Waggoner

[11] Patent Number: 4,718,214

[45] Date of Patent: Jan. 12, 1988

[54] REINFORCED SIDING PANEL

[75] Inventor: Richard L. Waggoner, Riverside, Calif.

[73] Assignee: Alumax, Inc., San Mateo, Calif.

[21] Appl. No.: 906,748

[22] Filed: Sep. 12, 1986

[51] Int. Cl.[4] ..... E04C 2/32

[52] U.S. Cl. ..... 52/801; 52/519; 52/309.13

[58] Field of Search ..... 52/519, 531, 309.11, 52/801, 800, 795, 579, 309.13

[56] References Cited

U.S. PATENT DOCUMENTS

| | | | |
|---|---|---|---|
| 2,233,735 | 3/1941 | Fay | 52/801 X |
| 3,110,130 | 11/1963 | Trachtenberg . | |
| 3,137,970 | 6/1964 | Tiernan . | |
| 3,151,712 | 10/1964 | Jackson . | |
| 3,339,333 | 9/1967 | Kovalcik | 52/531 X |
| 3,641,595 | 2/1972 | Viessmann . | |
| 3,815,310 | 6/1970 | Kessler | 52/801 X |
| 3,998,021 | 12/1976 | Lewis . | |
| 4,033,802 | 7/1977 | Culpepper et al. | 52/531 X |
| 4,320,613 | 3/1982 | Kaufman | 52/531 X |
| 4,414,257 | 11/1983 | Haraga et al. . | |
| 4,461,665 | 7/1984 | Schertler . | |
| 4,615,166 | 10/1986 | Head | 52/795 X |
| 4,646,499 | 3/1987 | Wilson | 52/801 X |

FOREIGN PATENT DOCUMENTS 2830776 1/1980 Fed. Rep. of Germany ..... 52/801

OTHER PUBLICATIONS

"Plastic Corrugated Widens its Commercial Beachhead", *Modern Packaging, Mar. 1974.*

Brochure on "New Tru-Cor Plastic Corrugated System", Jan. 1975.

"Modern Plastics"—Plastics Corrugated Climbs Out of the Box, *Modern Plastics,* Mar. 1974.

Alumax Building Products brochure, "Three Great Ideas in Aluminum Siding."

*Primary Examiner*—J. Karl Bell

*Attorney, Agent, or Firm*—Limbach, Limbach & Sutton

[57] ABSTRACT

A reinforced siding panel comprising, in combination, a metal sheet having interior and exterior surfaces and a contoured plastic sheet adhesively bonded to the interior surface of said metal sheet, wherein said plastic sheet includes a first regular pattern of protruding surfaces bonded to said interior surface of the metal sheet from said interior surface of the metal sheet. The plastic sheet provides greater rigidity to the panel while reducing the weight of the panel compared to a thicker metal sheet.

14 Claims, 7 Drawing Figures

REINFORCED SIDING PANEL

FIELD OF THE INVENTION

The invention relates generally to siding panels, and relates more particularly to a metal siding panel that is reinforced by a contoured plastic sheet.

DESCRIPTION OF THE RELEVANT ART

It is well known to provide metal siding fabricated of sheet material such as aluminum for use on dwellings. Such metal siding typically has a composite structure, consisting of an outer metal sheet and a backing. Backings are commonly made of plastic foam or fibreboard, although other materials including wood or synthetic resins have been used, and are generally solid or nearly solid. The backing often provides insulation for the siding panel, as well as support to prevent the siding from being easily damaged. A backing-reinforced metal siding panel is generally lighter and less costly than a metal sheet of sufficient thickness to provide the desired strength.

The use of siding on mobile homes or trailers, however, provides an additional set of problems. A backing is still desirable for strength and insulation, but the backing must be light to keep the weight of the vehicle as low as possible. Thus, wood is not an optimum material. Synthetic resins of the type used in siding for permanent housing do not provide the stiffness and resistance to deformation desired. Fibreboard becomes useless when wet. The typical solution to these concerns previously has been the use of a plastic foam to fill the volume between the siding and the interior walls of the vehicle. This foam, however, is not sufficiently fireproof nor does it provide the amount of rigidity preferred. It is also susceptible to cracking if deformed, and will decompose if it is exposed to excessive moisture.

SUMMARY OF THE INVENTION

Accordingly, it is desired to provide a novel insulated siding panel having a backing which is as light as possible while still providing strength and insulation to the vehicle, and which is easy and inexpensive to manufacture. It is also desirable to adapt the backing to various shapes of siding panels.

The foregoing and related features are readily attained in the present invention, a reinforced aluminum siding panel comprising, in combination, a metal sheet having interior and exterior surfaces and a contoured plastic sheet adhesively bonded to the interior surface of said metal sheet, wherein said plastic sheet includes a first regular pattern of protruding surfaces bonded to said interior surface of the metal sheet and a second regular pattern of protruding surfaces spaced from said interior surface of the metal sheet. In the preferred embodiment, the metal sheet is aluminum, although other metals might be used, such as steel. The plastic sheet may be polyvinyl chloride (PVC), polypropylene, polyethylene, styrene, or a similar material.

The plastic sheet is the backing which stiffens the composite panel. The plastic sheet is preferable over backing materials of the prior art in that it is of lighter weight while retaining strength and durability, it may be pre-fabricated, it is of low cost, is unaffected by moisture, and the flexibility of the composite panel can be controlled.

The pattern of protruding surfaces of the plastic sheet determines the amount and direction of rigidity provided by the backing. The use of a corrugated backing having longitudinal channels provides rigidity in only one direction, that being the direction of the channels. This enables the panel to easily bend in the lateral direction for use in situations where the siding must bend only in one direction.

A different pattern of the plastic sheet, that of regularly spaced diamonds, allows some flexibility in both directions but in varying degrees, being less flexible in the direction of the longer axis of the diamond.

In another embodiment, the metal sheet can be contoured so that it provides its own rigidity in one direction, with the plastic sheet contoured to match the interior surface of the metal sheet but providing stiffness in the other direction, the net effect being that the siding is rigid in both directions.

In all of the embodiments, the assembly will have air spaces on either side of the plastic sheet due to the protruding surfaces of the sheet. These provide insulation for both heat and sound.

The plastic is lighter than thicker metal would be, resulting in a panel that is suitable for use on travel trailers and mobile homes. The assembly is also durable and easy and inexpensive to manufacture.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE ILLUSTRATED EMBODIMENTS

FIGS. 1 through 7 of the drawings depict various preferred embodiments of the present invention for purposes of illustration only. One skilled in the art will readily recognize from the following discussion that alternative embodiment of the structures and methods illustrated herein may be employed without departing from the principles of the invention described herein.

Figure 1:
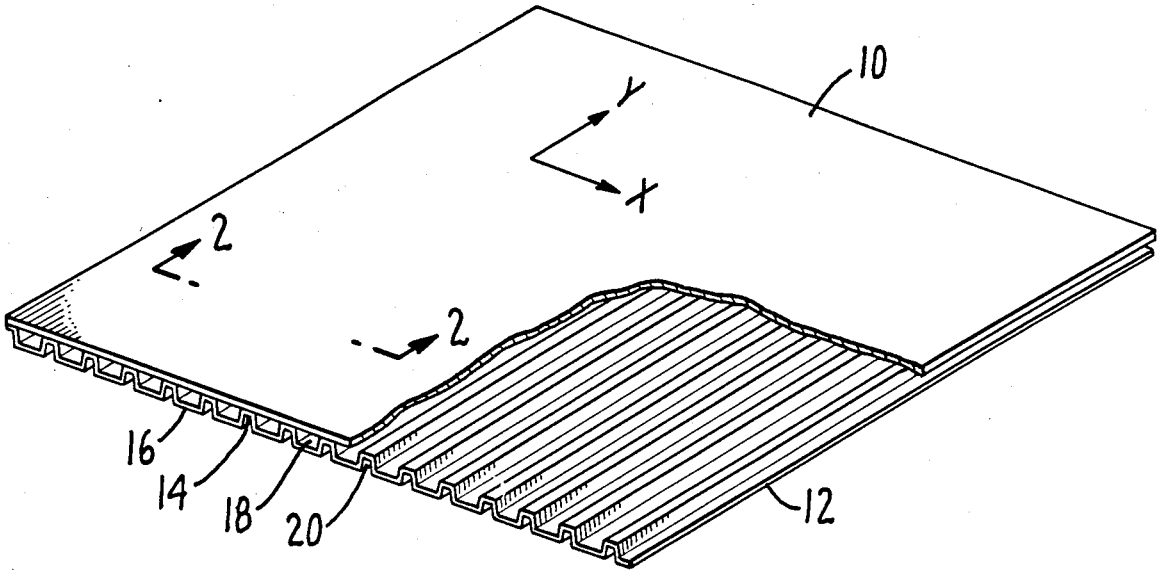
FIG. 1 is a perspective view of one embodiment of the present invention with portions broken away and in section.
Figure 2:
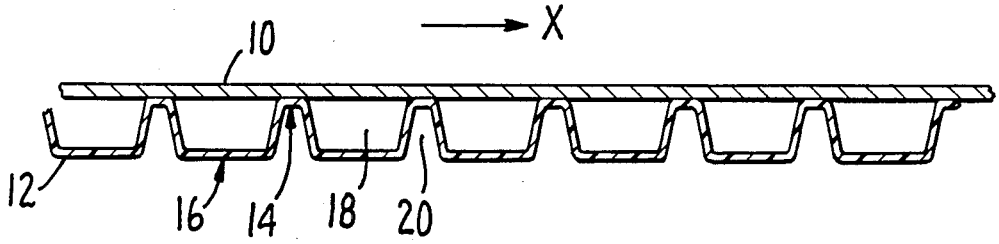
FIG. 2 is a vertical sectional view taken generally along line 2—2 in FIG. 1.

FIGS. 1 and 2 show a siding panel which is one embodiment of the present invention. Metal sheet 10 is attached to plastic sheet 12 by an adhesive. Plastic sheet 12 has a regular series of rectangular corrugations which have first protruding surfaces 14 bonded to metal sheet 10 and second protruding surfaces 16 spaced away from metal sheet 10. Channels 18 are thus defined between the plastic sheet 12 and metal sheet 10 and other channels 20 between plastic sheet 12 and the vehicle surface (not shown) on which the panel assembly is mounted.

The air trapped in the channels 18 and 20 provides both heat and sound insulation. Plastic sheet 12 causes the assembly to be stiff in the direction indicated as Y on FIG. 1, parallel to the direction of channels 18 and 20, but allows it to bend in the direction X, perpendicular to the direction of channels 18 and 20.

Figure 3:
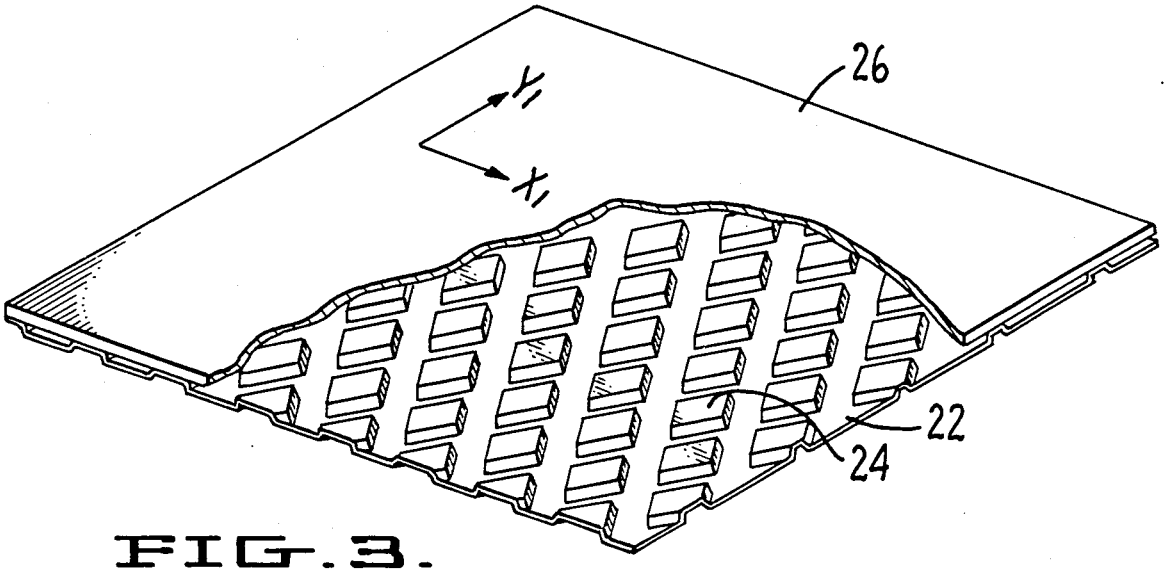
FIG. 3 is a perspective view of a second embodiment of the present invention with portions broken away and in section.

Another embodiment is shown in FIG. 3. Here the plastic sheet 22 has a regular pattern of first protruding surfaces 24 each in the shape of a diamond. These protruding surfaces 24 are bonded to the inner surface of metal sheet 26. While air spaces are defined in a similar fashion as in the panel shown in FIG. 1, the assembly is now somewhat flexible in both directions, but is more flexible in the direction indicated as $X_1$, the direction of the short axis of the diamond shape, than in the direction of $Y_1$, the direction of the long axis of the diamond.

Figure 4:
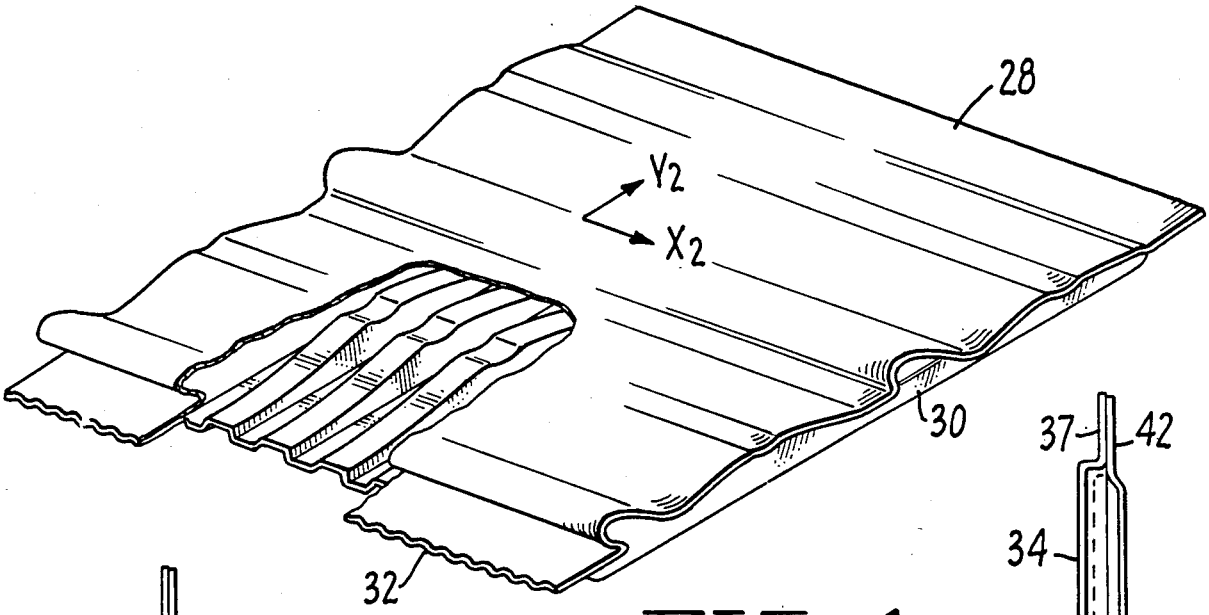
FIG. 4 is a perspective view of a third embodiment of the present invention with portions broken away and in section.
Figure 5:
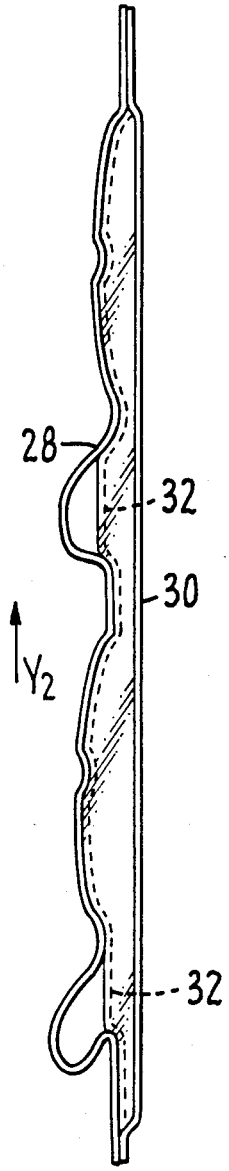
FIG. 5 is a vertical sectional view taken generally along the line 5—5 in FIG. 4.

Still another embodiment is shown in FIGS. 4 and 5. Here metal sheet 28 is contoured. Plastic sheet 30 here is corrugated as in FIG. 1, but is also contoured such that the first protruding surfaces 32 match the contour of the inner surface of metal sheet 28 as much as possible. While the first protruding surfaces 32 do not completely fill the contour of metal sheet 28, this is not essential.

Now, however, the panel assembly is nearly inflexible in both directions. Since the contours of metal sheet 28 are ribs running in the direction of $X_2$, the panel cannot be bent in that direction without seriously deforming metal sheet 28. Plastic sheet 30 prevents the assembly from bending easily in the direction $Y_2$, since the channels run longitudinally in that direction. This panel is thus stiffer than those shown in FIGS. 1 and 3 and hence much less adaptable to curved surfaces.

Figure 6:
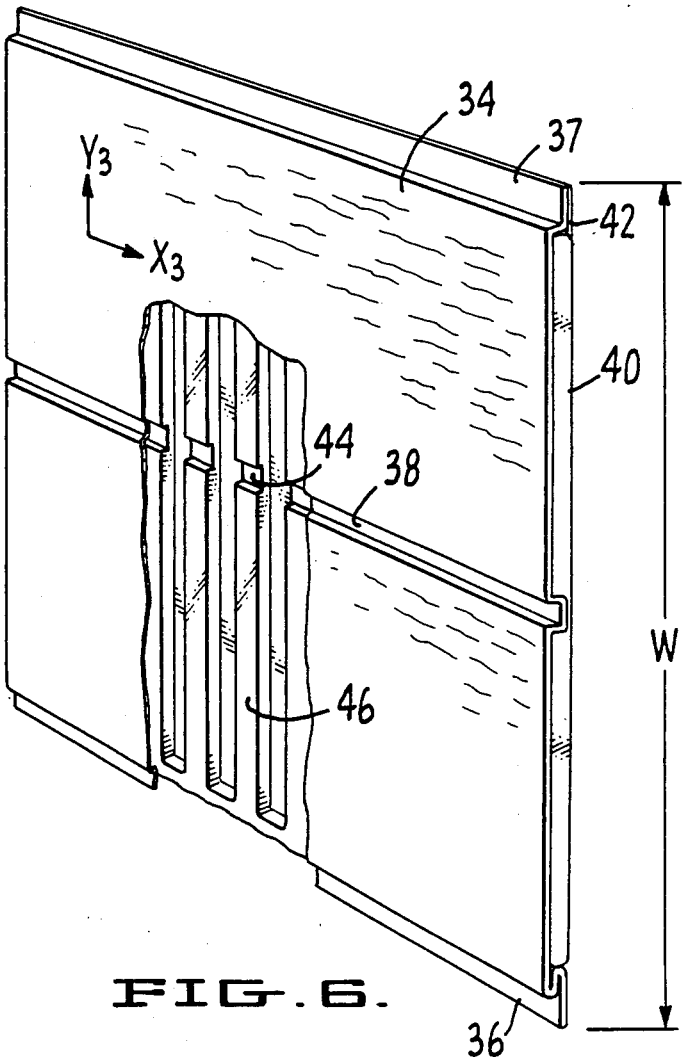
FIG. 6 is a perspective view of a fourth embodiment of the present invention with portions broken away and in section.
Figure 7:
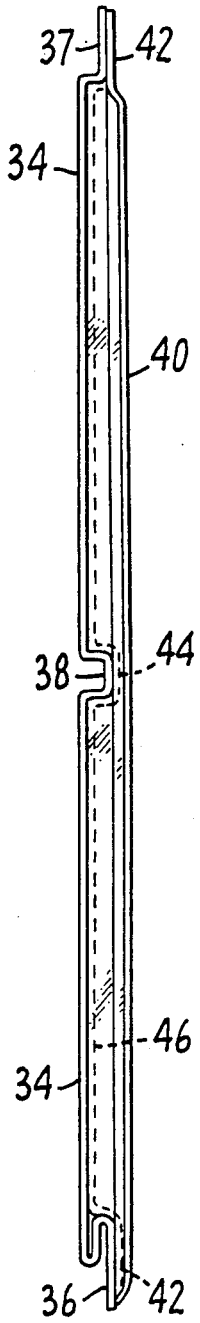
FIG. 7 is a vertical sectional view taken generally along the line 7—7 in FIG. 6.

FIGS. 6 and 7 show still another embodiment of the invention. Now metal sheet 34 is a section of a given width W and a length which is multiple number of times the width. Metal sheet 34 is folded along the top and bottom edges so that there are formed recessed flanges 36 and 37 which provide a flat area for mounting the assembly. Running longitudinally down the center of metal sheet 34 is an inwardly facing rib 38. Plastic sheet 40 has flat areas 42 to match the flanges 36 and 37, an inwardly facing rib 44 that matches rib 38 and first protruding surfaces 46 which are again corrugations to be adhered to the remaining generally flat areas of metal sheet 34.

The inwardly facing rib 38 and the folds in metal sheet 34 that lead to flanges 36 and 37 provide stiffness in the direction of $X_3$. Plastic sheet 40 provides stiffness in the direction of $Y_3$, parallel to the channels defined in plastic sheet 40, and perpendicular to the direction of the contours of metal sheet 34.

The flanges 36 and 37 are made such that flange 37 fits into a slot defined in flange 36 so that the panels overlap when installed and thus create a continuous covering for the vehicle.

This embodiment, as the others, has cavities in which air is trapped providing heat and sound insulation. As with the assembly shown in FIG. 3, this embodiment is rigid in both directions and thus not well suited to rounded shapes.

From the above description, it will be apparent that the invention disclosed herein provides a novel and advantageous reinforced siding panel. The foregoing discussion discloses and describes merely exemplary methods and embodiments of the present invention. As will be understood by those familiar with the art, the invention may be embodied in other specific forms without departing from the spirit or essential characteristics thereof. For example, different metals or plastics may be used, and different patterns of the protruding surfaces of the plastic sheet will yield different degrees of rigidity.

Accordingly, the disclosure of the present invention is intended to be illustrative, but not limiting, of the scope of the invention, which is set forth in the following claims.

What is claimed is:

1. A reinforced siding panel comprising, in combination:

a metal sheet having interior and exterior surfaces;

a single contoured plastic sheet attached to the interior surface of said metal sheet, wherein said plastic sheet extends over substantially the entirety of said interior surface of the metal sheet and includes a first regular pattern of protruding surfaces bonded to said interior surface of the metal sheet and a second regular pattern of protruding surfaces spaced from said interior surface of the metal sheet.

2. A panel as recited in claim 1 wherein said metal sheet is composed of aluminum and said plastic sheet is composed of polyvinyl chloride.

3. A panel as recited in claim 1 wherein the first and second regular patterns of protruding surfaces of said plastic sheet comprise linear corrugations of said plastic sheet.

4. A panel as recited in claim 1 wherein the first regular pattern of protruding surfaces of said plastic sheet comprises a regular pattern of diamonds.

5. A panel as recited in claim 1 wherein said metal sheet is contoured and the first regular pattern of protruding surfaces of said plastic sheet is contoured such that it may be generally juxtaposed to the interior surface of said metal sheet.

6. A panel as recited in claim 5 wherein the contoured metal sheet is generally rectangular, with a length a multiple number of times greater than its width, having a rib spaced intermediate the longitudinal edges and a flat flange on each longitudinal edge for mounting the sheet, wherein one flange has a U-shaped channel facing outward in the plane of the sheet for receiving the opposite flange of the next sheet.

7. A panel as recited in claim 5 wherein the contours of said metal sheet are all generally parallel to one another and the first and second protruding surfaces of said plastic sheet comprise linear corrugations of said plastic sheet that are oriented in a direction perpendicular to the contours of said metal sheet such that the panel is rigid in all directions.

8. A panel as recited in claim 5 wherein the distance from the first pattern of protruding surfaces of the plastic sheet to the second pattern of protruding surfaces of the sheet is approximately uniform all across the interior surface of the metal panel.

9. A reinforced siding panel comprising, in combination:

a metal sheet having interior and exterior surfaces;

a generally planar, contoured plastic sheet attached to the interior surface of said metal sheet, wherein said plastic sheet is deformed to have a first regular pattern of protruding surfaces, said plastic sheet being attached to said interior surface of the metal sheet at said protruding surfaces.

10. A panel as recited in claim 9 wherein the first regular pattern of protruding surfaces of said plastic sheet comprises linear corrugations of said plastic sheet.

11. A panel as recited in claim 9 wherein said metal sheet is contoured and the first regular pattern of protruding surfaces of said plastic sheet is contoured such that it generally conforms to the interior surface of said metal sheet.

12. A panel as recited in claim 9 wherein said first regular pattern of protruding surfaces of said plastic sheet comprises a regular pattern of diamonds.

13. A panel as recited in claim 9 wherein said first regular pattern of protruding surfaces of said plastic sheet form a generally planar surface which is parallel to the plane of the plastic sheet.

14. A panel as recited in claim 9 wherein said plastic sheet has at least one set of planar surfaces which are generally parallel to said interior surface of said metal sheet.

* * * * *